US006042615A

United States Patent [19]

Habereder et al.

[11] Patent Number: 6,042,615

[45] Date of Patent: Mar. 28, 2000

[54] SILICONE SOFTENER FOR JEANS FABRIC

[75] Inventors: Peter Habereder, Krailing; Martina Obenhuber; Michael Geck, both of Burghausen, all of Germany

[73] Assignee: Wacker-Chemie GmbH, Munich, Germany

[21] Appl. No.: 09/085,744

[22] Filed: May 27, 1998

[30] Foreign Application Priority Data

May 30, 1997 [DE] Germany ..... 197 22 680

[51] Int. Cl.[7] ..... D06P 5/08; D06P 1/52; D06P 1/48

[52] U.S. Cl. ..... 8/102; 8/115.6; 8/196; 8/116.1; 8/189; 8/181; 8/115.56; 8/115.57; 8/115.58; 8/115.59; 8/115.61; 8/115.65; 8/115.66; 8/101; 8/107; 8/111; 427/385.5; 427/386; 427/387; 427/394; 442/99; 442/102

[58] Field of Search ..... 8/115.6, 196, 116.1, 8/189, 181, 115.56, 115.57, 115.58, 115.59, 115.61, 115.65, 115.66, 102, 101, 107, 111; 427/385.5, 386, 387, 394; 442/99, 102

[56] References Cited

U.S. PATENT DOCUMENTS

| | | | |
|---|---|---|---|
| 5,114,426 | 5/1992 | Milora et al. | 8/102 |
| 5,133,897 | 7/1992 | Balzer | 252/312 |
| 5,254,269 | 10/1993 | Taylor et al. | 510/328 |
| 5,466,746 | 11/1995 | Geck et al. | 524/837 |
| 5,480,567 | 1/1996 | Lam et al. | 510/519 |

FOREIGN PATENT DOCUMENTS

| | | |
|---|---|---|
| 0418479 | 3/1991 | European Pat. Off. . |
| 0622397 | 11/1994 | European Pat. Off. . |
| 0622397 | 6/1996 | European Pat. Off. . |
| 4131551 | 3/1993 | Germany . |
| 196 03 401 | 8/1997 | Germany . |

OTHER PUBLICATIONS

The Condensed Chemical Dictionary, seventh edition, Reinhold Publishing Corp. (month unknown), 1966.

Barndt et al, Text. Chem. Color., vol. 21, No. 12, pp. 16–18, Dec. 1989.

Vergilbung von indigohaltiger Jeanswear, Nov. 1996, p. 786 et seq., 1996 (Month Unknown).

Derwent Abstract corresponding to DE 4131551 (#93–101968/13), Mar. 1993.

Derwent Abstract corresponding to EP–A 418479 (#91–051985/08), Mar. 1991.

Derwent Abstract (#97–394495 [37]) corresponding to DE 19603401, Aug. 1997.

Derwent Abstract (#93–101968 [13]) corresponding to DE 4131551, Mar. 1993.

*Primary Examiner*—Alan Diamond

*Attorney, Agent, or Firm*—Brooks & Kushman P.C.

[57] ABSTRACT

The invention relates to an indigo-dyed fabric which comprises at least one organopolysiloxane and at least one alkyl polyglycoside.

19 Claims, No Drawings

SILICONE SOFTENER FOR JEANS FABRIC

Priority is claimed to German Patent Application 19722680.9 filed May 30, 1997.

TECHNICAL FIELD

The invention relates to fabric dyed with indigo, and a process for the treatment of a fabric dyed with indigo.

BACKGROUND ART

Fabric dyed with indigo is chiefly so-called denim fabric, which is a coarse cotton fabric mainly used for the production of so-called blue jeans, that is to say jeans and other articles of clothing based on denim fabrics, such as, for example, shirts, jackets, skirts and the like. These articles of clothing are produced by special processes characteristic of this type of clothing.

For the production of dyed textiles, the web of material on which they are based is usually dyed continuously or discontinuously. Only after this process is the web of material further processed by an expedient finishing treatment and finally made up, usually in another plant.

In exceptional cases, such as, for example, in the case of short-lived fashion articles (T-shirts), the undyed, made-up article of clothing can also be subsequently dyed, according to requirements. Piece dyeing is referred to here.

In the case of jeans fabrics (denims), on the other hand, the dyeing process is carried out in a very early production stage. The so-called "warp" is thus already sized and dyed in a combined working operation before the weaving process. "Size dyeing" is referred to here. This warp is then woven with an undyed weft thread, from which comes the characteristic denims fabric appearance. For reasons of cost, starch or starch derivatives are usually used for the sizing.

A wide range of the most diverse color shades and, depending on the type of fiber, a characteristic choice of classes of dye are available for textile dyeing.

In contrast, conventional jeans fabrics are usually produced from cotton and dyed blue.

There are indeed denim articles in the most diverse color shades, but conventional jeans fabric is blue. "Blue jeans" is a generic term firmly anchored in the language. Also traditionally, jeans fabrics must be dyed with indigo. Indigo is a natural dye, although nowadays it is chiefly prepared synthetically.

As already mentioned, the finishing of a textile substrate is usually carried out by the textile processor after dyeing. Only then are the goods sent for making up.

In the case of jeans fabrics, however, the fabric in the loom state is already made up to the article of clothing. "Processing" is carried out only during washing of the already-sewn pieces in plants which are particularly specialized for this, the so-called "jeans fabrics washers". Special drum washing machines are usually used for this. The inflexible and rigid pieces are first carefully softened to avoid crease folds, and troublesome chemicals, such as alkali and excess dye, are washed off.

After an optimum pH has been established, the pieces are then enzymatically desized, that is to say the starch size is broken down by amylase enzymes into soluble fragments and these are rinsed out. As a result, the fabric loses at least some of its stiffness.

In accordance with current fashion, a considerable percentage of the color applied is then removed by bleaching, until the article of clothing is no longer dark blue but appears in defined medium to light blue shades. This bleaching is predominantly effected by chlorination. Alternative processes, such as, for example, reductive bleaching (sugar wash) are also known.

If required by fashion, washing with lava stones is also carried out (so-called "stone-wash" process), which imparts to the trousers damaged by abrasion the so-called "worn-out look".

Recently, the use of cellulose enzymes in the washing has been promoted. However, these enzymes attack the cotton of the fabric itself and therefore make it softer.

Textile softeners are additionally added, however, to high-quality jeans fabrics while these are still in the rinsing bath, in order to impart to them a particularly good and soft handle.

Since the softeners for jeans clothing are applied in the rinsing bath of the washing machine, they must have a certain tendency to be absorbed substantively on to the goods from a long liquor. The products based on dispersions of polyethylene or wax and softeners based on fatty acid polyglycol ethers which are currently used are not optimum in the criteria of "soft handle" and absorption capacity. Cationic fatty softeners which are capable of absorption have even less favorable properties.

The use of amino-functional silicones as softeners would be desirable per se, since these substances result in a particularly good soft handle and, owing to their cationic charge, also have substantivity with respect to the negatively charged cotton. There is unfortunately—quite rightly—an aversion to silicone softeners in jeans fabrics: Jeans goods often remain in shops for a relatively long time before being sold. When stored in a stack, only the edges are exposed here to the direct action of the atmosphere. Air pollutants, such as ozone or nitrogen oxide ($NO_x$), however, can damage the blue indigo dye, i.e. oxidize it to yellow isatin.

Jeans can therefore lose their color, specifically at edges in storage. This "ozone fading" makes these goods unsellable, especially since it occurs only locally. There is agreement in technical circles that although silicone softeners do not cause this ozone fading, they certainly promote and intensify it. The silicone softeners, which are actually particularly effective for this intended use, are therefore rejected. See also Melliand Textilberichte, "Vergilbung von indigohaltiger Jeanswear" [Yellowing of indigo-containing jeanswear] 11/96, page 786 et seq., 1996, where the influence of the soft handle agent and storage time is stated on page 787 under 6:

> "Of the soft handle agents investigated (various fatty acid condensation products, and amino-functional polysiloxane and a handle agent based on polyurethane) none causes intrinsic yellowing under the action of harmful gas. However, silicone-containing products accelerate the degradation of indigo by harmful gas. Individual fatty acid condensation products significantly reduce the yellowing of jeanswear. The longer jeanswear is exposed to the action of harmful gas, the greater the probability of the development of irreparable lightening and yellowing. According to observations in practice, there is a yellowing maximum which is stationary under lasting lightening."

Our own experiments have shown that this reduction is not based on prejudice. In fact, an intensification of the deviation in color of denim fabrics can also be found experimentally if these have been treated with commercially available silicone softeners before the action of ozone or $NO_x$ (Example 1).

This effect is practically independent of whether the softener is present in the form of a micro- or macroemulsion, and of what viscosity, amine number or structure the silicone has.

Surprisingly, it has now been found that it is not the silicone but the emulsifier usually used for the emulsification which is responsible for this ozone fading, regardless of whether it is based on fatty alcohol ethoxylate or alkylphenol ethoxylate (Example 2).

Silicones which, unusually in practice and purely for experimental purposes, were applied to the fabric as a solution in non-polar solvents have no effect-intensifying action. On the other hand, ethoxylated emulsifiers promote ozone fading.

This action seems to be largely independent of the hydrophobic radical (straight- or branched-chain fatty alcohol, alkylphenol), independent of the degree of ethoxylation (n=5–10) and independent of the manufacturer of the surfactant. Any differences in the Gaussian distribution, the process control and possibly the catalysis during the ethoxylation therefore do not seem to play a role.

SUMMARY OF THE INVENTION

The object of the invention is therefore to overcome these disadvantages of the prior art and in particular to provide softeners based on silicone which do not show these disadvantages, such as the yellowing of jeans fabric. This object is achieved by the invention.

DESCRIPTION OF THE PREFERRED EMBODIMENT

Surprisingly, it has been found that emulsions of amino-functional silicones which have been prepared employing alkyl polyglycosides as emulsifiers do not intensify the ozone fading of indigo-dyed denim fabric softened with them. This applies to the action of ozone and also of $NO_x$. (Examples 3 and 4)

Such emulsions are described in EP 0622397 (Wacker) and DE 4131551 (Pfersee).

The invention relates to indigo-dyed fabric which comprises at least one organopolysiloxane and at least one alkyl polyglycoside.

Indigo-dyed fabric is in principle any form of fabric, but preferably indigo-dyed cotton fabric, linen fabric, viscose fabric or fabric of synthetic fiber, cotton fabric being preferred, and denim fabric being particularly preferred.

The organopolysiloxanes are preferably organopolysiloxanes (a) which contain polar groups on SiC-bonded hydrocarbon radicals, such as, preferably, amino, ammonium, epoxy, hydroxyl, amido, mercapto, carboxyl and/or sulfuric acid groups, salts or esters thereof.

The organopolysiloxanes (a) preferably have the general formula (1)

$$R_nR_m'SiO_{(4-n-m)/2} \quad (I)$$

in which

R is preferably identical or different, optionally substituted hydrocarbon radicals or hydrocarbonoxy radicals having in each case 1 to 18 carbon atoms, hydrogen atoms or hydroxyl radicals, R' is preferably identical or different, SiC-bonded substituted hydrocarbon radicals containing polar groups, n is an integer having the value of 0, 1, 2 or 3, m is an integer having the value of 0, 1, 2 or 3 and the sum n+m has an average value of 1.8 to 2.2 and m is chosen such that the polyorganosiloxane contains at least one radical R'.

The sum n+m preferably has an average value of 1.9 to 2.1.

Examples of hydrocarbon radicals R are preferably alkyl radicals, such as the methyl, ethyl, n-propyl, iso-propyl, n-butyl, iso-butyl, tert-butyl, n-pentyl, iso-pentyl, neopentyl or tert-pentyl radicals; hexyl radicals, such as the n-hexyl radical; heptyl radicals, such as the n-heptyl radical; octyl radicals, such as the n-octyl radical and iso-octyl radicals, such as the 2,2,4-trimethylpentyl radical; nonyl radicals, such as the n-nonyl radical; decyl radicals, such as the n-decyl radical; dodecyl radicals, such as the n-dodecyl radical; octadecyl radicals, such as the n-octadecyl radical; alkenyl radicals, such as the vinyl, allyl and the 5-hexen-1-yl radicals; cycloalkyl radicals, such as cyclopentyl, cyclohexyl and cycloheptyl radicals and methylcyclohexyl radicals; aryl radicals, such as the phenyl, naphthyl and anthryl and phenanthryl radical; alkaryl radicals, such as o-, m-, and p-tolyl radicals, xylyl radicals and ethylphenyl radicals; and aralkyl radicals, such as the benzyl radical and the α- and β-phenylethyl radical.

Examples of optionally substituted hydrocarbonoxy radicals R are preferably substituted and unsubstituted hydrocarbon radicals R according to the above-mentioned examples which are bonded via an oxygen atom bonded directly to a silicon atom, in particular alkoxy radicals having 1 to 18 carbon atoms and phenoxy radicals, specifically the methoxy, ethoxy, n-propoxy, iso-propoxy and phenoxy radical. Preferably, not more than 5% of the radicals are optionally substituted hydrocarbonoxy radicals.

Examples of preferred amino-functional radicals R' are radicals of the general formula (II)

$$—R^1—[NR^2(CH_2)_a]_bNHR^2 \quad (II)$$

and ammonium salts thereof which can be prepared by reaction with mineral or carboxylic acids, in which $R^1$ is preferably a divalent $C_1$- to $C_{18}$-hydrocarbon radical, $R^2$ is preferably a hydrogen atom or an optionally fluorine-, chlorine- or bromine-substituted $C_1$- to $C_{18}$-hydrocarbon radical, a has the values 2, 3, 4, 5 or 6 and b has the values 0, 1, 2, 3 or 4.

Examples of the divalent $C_1$- to $C_{18}$-hydrocarbon radicals $R^1$ are preferably unsaturated straight- or branched-chain or cyclic alkylene radicals, such as the methylene and ethylene radical, as well as propylene, butylene, pentylene, hexylene, 2-methylpropylene, cyclohexylene and octadecylene radicals, or unsaturated alkylene or arylene radicals, such as the hexenylene radical and phenylene radicals, the n-propylene radical and the 2-methylpropylene radical being particularly preferred.

Examples of the hydrocarbon radicals $R^2$ are preferably the examples mentioned for R. Examples of halogen-substituted hydrocarbon radicals $R^2$ are haloalkyl radicals, such as the 3,3,3-trifluoro-n-propyl radical, the 2,2,2,2',2',2'-hexafluoroisopropyl radical and the heptafluoroisopropyl radical, and haloaryl radicals, such as the o-, m- and p-chlorophenyl radical.

In the above general formula (II), preferably, $R^1$ is a divalent $C_2$- to $C_6$-hydrocarbon radical, $R^2$ is a hydrogen atom or a methyl or cyclohexyl radical, a has the value 2 or 3 and b is the value 0 or 1.

Linear polydimethylsiloxanes which optionally contain as radicals R, in addition to methyl radicals, not more than 5% of $C_1$- to $C_3$-alkoxy or hydroxyl end groups are particularly preferred. These polydimethylsiloxanes preferably contain as radicals R' the radicals

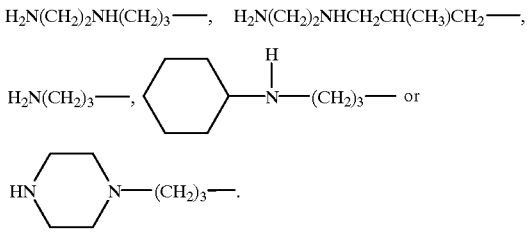

Examples of mineral acids which can be reacted with the above-mentioned arnino-functional hydrocarbon radicals to give the corresponding ammonium-functional radicals are, preferably, hydrochloric, perchioric, sulfuiric, sulfuirous, nitric, nitrous, hydrofluoric, phosphoric, diphosphoric and polyphosphoric acids. Examples of suitable carboxylic acids are, preferably, formic, acetic, propionic and butanoic acids, citric acid, trichioro-, dichloro- and chloroacetic acid, trifluoroacetic acid, cyanoacetic acid, phenylacetic acid, benzoic acid, m- and p-nitrobenzoic acid, oxalic acid, malonic acid and lactic acid. The ammonium-functional hydrocarbon radicals obtainable with acetic acid are particularly preferred.

Examples of amido-functional radicals are, preferably, the γ-acetamidopropyl radical and partly or completely acetylated β-aminoethyl-γ-aminopropyl radicals.

Examples of epoxy-functional radicals R' are radicals of the general formulae (III) and (IV)

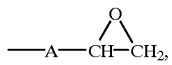

(III),

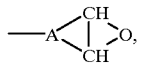

(IV), in which A is an alkyl, alkoxyalkyl, aryl or alkaryl radical.

Examples of preferred epoxy-functional radicals R' are the formulae

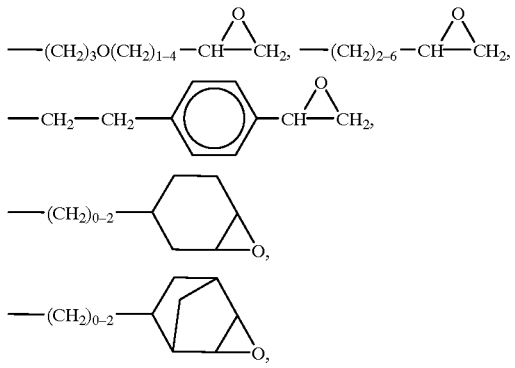

Particularly preferred epoxy-functional radicals R' are the formulae

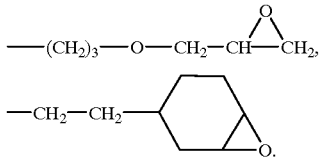

The preferred epoxide numbers of the epoxy-functional organopolysiloxanes (a) are 0.5–0.001 (equivalents/100 g), in particular 0.2–0.01 (equivalents/100 g). The epoxide number of an epoxy-functional organopolysiloxane indicates the number of equivalents of epoxide, that is to say the molar number of epoxide groups, contained in 100 grams of organopolysiloxane (a).

Examples of preferred carboxyl-functional radicals R' are radicals of the general formula (V)

$$—X—(COOH)_p \qquad (V),$$

and salts thereof which can be prepared by reaction with bases, in which

X is a linear, branched aliphatic, aromatic or mixed aliphatic-aromatic hydrocarbon radical, the carbon skeleton of which can be interrupted by divalent sulfuir, oxygen or carboxylic acid ester radicals, and p has the value 1 or 2.

Particularly preferred carboxyl-functional radicals R' are the radicals

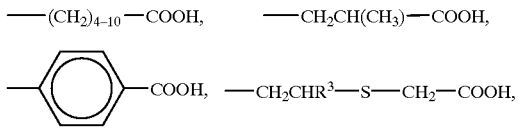

in which $R^3$ is preferably a hydrogen atom or a methyl or ethyl radical,

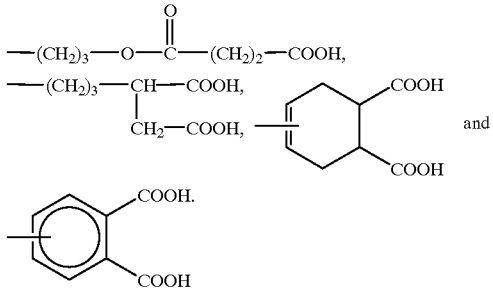

Particularly preferred carboxyl-functional radicals R' are preferably the radicals $—(CH_2)_{10}—COOH$, $—CH_2CH(CH_3)—COOH$ and $—(CH_2)_2—S—CH_2—COOH$.

Examples of bases for reaction with organopolysiloxanes (a) containing carboxyl-functional radicals R' are, preferably, ammonia, amines and alkali metal and alkaline earth metal hydroxides, such as LiOH, NaOH, KOH, RbOH, CsOH, $Mg(OH)_2$, $Ca(OH)_2$, $Sr(OH)_2$ and $Ba(OH)_2$.

The preferred acid numbers of the carboxyl-functional organopolysiloxanes (a) are 1–100 (mg of KOH/g), preferably 5–50, and in particular 10–30. The acid number of a carboxyl-functional organopolysiloxane (a) indicates the number of milligrams of potassium hydroxide necessary to neutralize the free acids contained in one gram of the carboxyl-functional organopolysiloxane (a).

The radicals R are preferably methyl, ethyl, phenyl, methoxy and/or vinyl radicals. For easier accessibility, preferably 50% of the radicals R, in particular at least 80% of the radicals R, are methyl radicals.

One organopolysiloxane (a), preferably one of the formula (I), can be employed; a plurality of organopolysiloxanes can also be employed.

The organopolysiloxane (mixture) employed in emulsions is preferably liquid. In particular, the organopolysiloxanes employed in the process according to the invention preferably in each case have viscosities of 100 mpa·s to 1,000,000 mpa·s, in each case measured at 25° C.

If an amino-functional organopolysiloxane is used for the preparation of the ammonium-functional organopolysiloxane (a) which is preferably employed in the emulsions according to the invention, it is preferable for it to have an amine number of 0.1 to 3.0, in particular 0.2 to 0.9. The amine number of an amino-functional substance is determined as the consumption in $cm^3$ of 1N hydrochloric acid on titration of 1 g of the amino-functional substance.

Examples of alkyl polyglycosides which can be employed are the alkyl polyglycosides described in EP-A 418 479, of the general formula (VI)

$$R''—O—Z_o, \quad (VI)$$

in which

R" is preferably a linear or branched, saturated or unsaturated alkyl radical having on average 8 to 24 carbon atoms, preferably 8 to 16 carbon atoms, and $Z_o$ is preferably an oligoglycoside radical having on average o=1 to 10, preferably 1 to 5 hexose or pentose units, or mixtures thereof.

Alkyl polyglycosides with a saturated alkyl radical having on average 8 to 14 carbon atoms and an average degree of glycosidation n of between 1.1 and 3 are particularly preferred.

The invention also relates to a process for the treatment of a fabric dyed with indigo, in which at least one organopolysiloxane and at least one alkyl polyglycoside are applied.

This is preferably carried out by treatment of the fabric dyed with indigo with an aqueous emulsion based on a) 100 parts by weight of organopolysiloxanes which preferably contain polar groups on SiC-bonded hydrocarbon radicals and b) preferably up to 150 parts by weight of alkyl polyglycosides.

The organopolysiloxanes and alkyl polyglycosides have the above-mentioned meaning.

In contrast to the aqueous emulsions of polydimethylsiloxane oils and polydiphenylsiloxane oils with alkyl polyglycosides, the emulsions employed according to the invention have a higher stability toward foreign electrolytes, such as salts of magnesium and sodium, than corresponding emulsions in which alkyl polyglycol ethers are used as emulsifiers.

The emulsions employed according to the invention comprise relatively small amounts of emulsifiers, in particular 5 to 100 parts by weight of alkyl polyglycosides (b) per 100 parts by weight of organopolysiloxanes (a) containing polar groups.

The emulsions employed according to the invention have a discontinuous oily phase, which comprises the organopolysiloxanes (a) containing polar groups, and a continuous aqueous phase.

The proportions of organopolysiloxane (a) and continuous aqueous phase can be varied within wide ranges, depending on what solids content is required in the emulsions and microemulsions employed according to the invention. The proportion of organopolysiloxane (a) is preferably between 20 and 70 percent by weight, but in particular between 40 and 60 percent by weight, of the total weight of the emulsion.

The emulsions employed according to the invention preferably have an average particle size of not more than 1 $\mu$m, in particular of not more than 300 nm. The microemulsions employed according to the invention preferably have an average particle size of not more than 150 nm, in particular not more than 20 nm. The term "emulsions" in the entire text also includes microemulsions. The term "microemulsions" relates only to emulsions which have an average particle size of not more than 150 nm and are transparent to optically clear. Microemulsions of organopolysiloxanes with alkyl polyglycosides as emulsifiers have not been previously described.

The emulsions employed according to the invention, in particular the microemulsions, can also comprise cosurfactants, for example for reducing the particle size and for reducing the amount of alkyl polyglycosides (b) required, preferably in amounts of 0 to 30 parts by weight, in particular not more than 20 parts by weight, in each case based on 100 parts by weight of the organopolysiloxanes (a).

Cosurfactants is understood as meaning polar compounds of average molecular weight, such as, preferably, alcohols of molecular size $C_4$ to $C_8$, suitable glycol ethers, amines, esters or ketones.

Examples of particularly suitable cosurfactants are, preferably, 1-butanol, 2-butanol, 2-methyl-2-propanol, 1-pentanol, 2-pentanol, 3-pentanol, 1-hexanol, 2-hexanol, 3-hexanol, 1-heptanol, 2-heptanol, 3-heptanol, 4-heptanol, 1-octanol, 2-octanol, 3-octanol and 4-octanol; diethylene glycol monomethyl, monoethyl and monobutyl ethers; diethylene glycol dimethyl and diethyl ethers; 1-aminobutane, 2-aminobutane, 2-amino-2-methylpropane, 1-aminopentane, 2-aminopentane, 1-aminohexane, 1-aminoheptane and 1-aminooctane; ethyl, propyl, isopropyl, butyl, isobutyl, pentyl, isopentyl and hexyl acetates; methyl, ethyl and tert-butyl propionates; methyl, ethyl, propyl and butyl butyrates; 2-butanone, 2-pentanone, 3-pentanone, 4-methyl-2-pentanone, 2-hexanone, 3-hexanone, 2-heptanone, 3-heptanone, 4-heptanone, 5-methyl-3-heptanone, 2-octanone and 3-octanone.

Examples of preferred cosurfactants are 1 -alkanols of the examples listed above with $C_5$ to $C_8$ chains, diethylene glycol monobutyl ether, diethylene glycol dimethyl and diethylene glycol diethyl ether, propyl, butyl and pentyl acetates and 2-pentanone.

Particularly preferred cosurfactants are 1-pentanol, 1-hexanol and 1-octanol, diethylene glycol monobutyl ether, diethylene glycol dimethyl ether and butyl acetate.

In addition to organopolysiloxane (a), alkyl polyglycosides (b), water and, where appropriate, cosurfactant; the emulsions employed according to the invention can also comprise additives. These are, in particular, bactericides, fungicides, algicides, microbicides, fragrances, corrosion inhibitors, dyes, pigments, thickeners and fillers. The emulsions according to the invention preferably comprise additives in amounts of 0 to 1 percent by weight, in particular 0 to 0.2 percent by weight, in each case based on the total weight of the finished emulsion.

All the components of the emulsion employed according to the invention can be mixed in any desired sequence using emulsifying apparatuses or by stirring together without exerting high shear forces. However, it is preferable for a homogeneous mixture of organopolysiloxane (a), alkyl polyglycosides (b) and water first to be prepared and the cosurfactants and additives, if employed, to be stirred into this mixture without exerting high shear forces.

The pressure exerted on the particular components or mixtures is preferably atmospheric pressure, increased, where appropriate, by the action of the mixing apparatus while the correspondingly prevailing temperature is preferably the room temperature, increased, where appropriate, by the action of the mixing apparatus.

The ammonium-functional organopolysiloxane (a) employed which is preferably contained in the emulsions employed according to the invention can be prepared by addition of mineral acids or carboxylic acids to corresponding amino-functional organopolysiloxanes. This addition of acid to the organopolysiloxane (a) may be carried out before the organopolysiloxane (a) is emulsified.

In a particularly preferred embodiment for the preparation of the emulsions employed according to the invention using particularly preferred amino- and/or ammonium-functional organopolysiloxanes (a), however, the ammonium-functional radicals are generated in situ during mixing of organopolysiloxane (a), alkyl polyglycosides (b) and water, by addition of the mineral and/or carboxylic acids described above, in particular acetic acid.

The emulsions employed according to the invention can in principle be prepared in any turbulent mixer which has also been used to date for the preparation of emulsions. Examples of mixers which can be used are stirrers, such as blade, beam, anchor, grid, screw, propeller, disk, impeller, turbine and planetary stirrers, single- and twin-screw mixers, mixing turbines, colloid mills, ultrasound mixers, in-line mixers, pumps and homogenizers, such as high-pressure, turbine and rotating homogenizers.

Sample Preparation:

Commercially available, indigo-dyed denim untreated fabric of 100% cotton was desized in a long liquor (500%) with 0.5 g/l bacterial amylase (Mucilase, Freedon/Diamalt) at pH 6.0 for 2 hours at 55° C. and then rinsed free from surfactants with clear water and dried at room temperature.

The samples of material were charged on a padder with aqueous emulsions or solutions of the test substances, in the case of the silicone oils with solutions in white spirit, such that about 1.0% of active substance, based on the fabric weight, was applied. Finally, the samples were dried at 150° C. for 5 minutes.

Gas Treatment:

Sample pieces 7×5 cm were sewn to one another and treated with gas in a glass tube. The concentration of ozone/$NO_x$ was about 200 mg/hour and the flow rate 2.0 l/hour. The oxidizing agent was generated by an ozone generator by electrical discharge in air, so that $O_3$ was present in addition to $NO_x$. The action time was in each case 60 minutes at room temperature. The samples were then rinsed and dried.

Ozonization Procedure:

The samples are treated in suspended form with ozone. Ozone is prepared from pure oxygen by "corona discharge" in an ozonizer. The oxygen flow rate is adjusted with the aid of a flow meter and measured with a gas meter at the end of the apparatus. At the ozonizer setting chosen, on average 200 mg of ozone are produced per hour.

To avoid severe agitation of the goods owing to the gas flow, the samples sewn together in a strip are weighted with a weight (about 30 g).

Conditions:

Ozone concentration: about 200 mg/hour

Flow rate: 2.0 l/hour

Treatment time: 60 minutes at room temperature

After the ozone treatment, the test specimens are treated in a Mathis dryer at room temperature for 20 minutes with circulating air (maximum level of ventilation) to separate residual ozone from the goods.

Measurement:

This is carried out in a colorimeter (Data Color Spectra Flash 600). The evaluation was made according to the loss in color strength in %.

EXAMPLE 1

Influence of softeners on the loss in color strength by O3/$NO_x$ treatment:

| Denim Treated With | Loss In Color Strength % $O_3/NO_x$ | Difference From the Blank Value |
|---|---|---|
| Water (Blank Value) | 5.3 | 0 |
| Si Softener 1 | 46.2 | 40.9 |
| Si Softener 2 | 41.9 | 36.6 |
| Si Softener 3 | 38.2 | 32.9 |
| Si Softener 4 | 38.3 | 33 |
| Si Softener 5 | 54.8 | 49.5 |
| Si Softener 6 | 48.4 | 43.1 |
| Si Softener 7 | 39.2 | 33.9 |
| PE Emulsion (Velustrol P 40, Hoechst AG) | 16.4 | 11.1 |
| PE Emulsion (Adalin NI, Henkel) | 16.5 | 11.2 |
| Cationic Fatty Softener (Quaternized tallow fatty acid amine) (Leomin AFK, Hoechst) | 30.5 | 25.2 |

PE = polyethylene

The terms here have the following meanings:

Silicone Softener 1:

Microemulsion of a low-viscosity, blocked silicone oil with aminoethylaminopropyl groups; oil viscosity 200 $mm^2/s$, amine number 0.25; emulsified with trimethylnonanol·6 EO Silicone Softener 2:

Macroemulsion of a high-viscosity, low-aminated reactive oil, oil viscosity 8000 $mm^2/s$; amine number 0.15; emulsified with iso-$C_{13}$-fatty alcohol·10 EO Silicone Softener 3:

Macroemulsion of the same oil as softener 2, emulsified with alkyltrimethylammonium chloride and nonylphenol·7 EO Silicone Softener 4:

Macroemulsion of a reactive amine-reactive silicone oil; oil viscosity 1000 $mm^2/s$, amine number 0.6; emulsified with a mixture of $C_{13}$-fatty alcohol·6 EO and $C_{13}$-fatty alcohol·8 EO Silicone Softener 5:

Microemulsion of a blocked, amine-rich oil; oil viscosity 1000 $mm^2/s$, amine number 0.6; emulsified with $C_{13}$-fatty alcohol·6 EO Silicone Softener 6:

Microemulsion of a reactive oil of medium amine content; oil viscosity 1000 $mm^2/s$; amine number 0.3; emulsified with $C_{13}$-fatty alcohol·6 EO Silicone Softener 7:

Microemulsion of a cyclohexylamino-functional (thermal yellowing low) silicone oil; oil viscosity 1000 $mm^2/s$; amine number 0.3; emulsified with $C_{13}$-fatty alcohol·6 EO with butyldiglycol as a co-emulsifier

EXAMPLE 2

Influence of the pure substances on the loss of color strength with $O_3/NO_x$ treatment

| Denim Treated With | Loss In Color Strength % $O_3/NO_x$ | Difference From the Blank Value |
|---|---|---|
| Water (Blank Value) | 5.3 | 0.00 |
| White Spirit (Blank Value) | 4.5 | 0.00 |
| Amino Silicone Oil 1 | 10 | 5.5 |
| Amino Silicone Oil 2 | 8.7 | 4.2 |
| Amino Silicone Oil 3 | 19.8 | 15.3 |
| Amino Silicone Oil 4 | 5.4 | 0.9 |
| $C_{13}$-Fatty Alcohol.10 EO (Arlypon IT 10/Grünau | 51 | 45.7 |
| $C_{13}$-Fatty Alcohol.6 EO (Genapol X060, Hoechst) | 34.8 | 29.5 |
| $C_{13}$-Fatty Alcohol.8 EO (Genapol X080, Hoechst) | 44.8 | 39.5 |
| Nonylphenol Ethoxylate (Marlophen NP7, Hüls) | 54.3 | 49 |
| Trimethylnonanol.6 EO (Tergitol TMN6, ICI) | 38.2 | 32.9 |
| Hexadecyltrimethyl-ammonium chloride (Genamin CTAC 50, Hoe) | 37.4 | 32.1 |
| Mixed Emulsifier of Silicon Softener 3 | 37.6 | 32.3 |

The terms have the following meanings

EO—Ethylene Oxide

Amino Silicone Oil 1

High-viscosity, low-aminated reactive oil; oil viscosity 8000 $mm^2/s$, amine number 0.15; employed in silicone softener No. 2

Amino Silicone Oil 2

Reactive oil of viscosity 1000 $mm^2/s$ amine number 0.3, employed in silicone softener No. 6

Amino Silicone Oil 3

Reactive, amine-rich silicone oil, viscosity 1000 $mm^2/s$; amine number 0.6, employed in silicone softener No. 4.

Amine Silicone Oil 4

Cyclohexylamino-functional, high-viscosity oil, viscosity 7000 $mm^2/s$ and amine number 0.20. Similar to the oil from silicone softener No. 7, but of higher viscosity and lower amination.

EXAMPLE 3

Preparation of Softener Emulsions for Treatment of Denims:

Softener 8:

17 parts of a blocked, high-aminated amino silicone oil (amine number=0.6; viscosity=1000 $mm^2/s$) were stirred with 8.6 parts of alkyl polyglycoside (70% pure), 74 parts of completely desalinated water and 0.3 part of acetic acid 100% pure to give an emulsion, which was preserved with 3.5 g/l of formalin solution. The oil was identical to the product used in softener 5. The emulsifier used was Glucopon 225 DK (Henkel), a $C_8$–$C_{10}$-alkyl polyglycoside with 1.7 sugar units and an active content of 70%.

Softener 9:

An emulsion was prepared analogously from the reactive oil also employed in softener 4, according to the recipe of softener 8.

Softener 10:

The low-amine high-viscosity silicone oil already employed in softeners 2 and 3 was emulsified in an amount of 17 parts with 9.5 parts of Glucopon 215 CSUP (Henkel) and 0.08 part of acetic acid and the emulsion was preserved with 3.5 g/l of formalin solution. Glucopon 215 CSUP is a $C_8$–$C_{10}$-alkyl polyglycoside with 1.5 sugar units.

Softener 11:

17 parts of the amine oil of amine number 0.3 used in softener 6 were emulsified with 8.6 parts of Glucopon 225 DK as described for softener 8, but with an amount of acetic acid reduced to 0.15 part.

EXAMPLE 4

Influence of softeners based on amino silicone/alkyl polyglycosides on the loss of color strength with $O_3/NO_x$ treatment:

| Denim Treated With | Loss In Color Strength % $O_3/NO_x$ | Difference From the Blank Value |
|---|---|---|
| Water (Blank Value) | 7 | 0.00 |
| Softener 8 | 20.2 | 13.2 |
| Softener 9 | 26 | 19 |
| Softener 10 | 21 | 14 |
| Softener 11 | 18.8 | 11.8 |

The loss in color strength in % caused by softeners according to the invention is thus considerably lower than when conventional silicone emulsions (Example 1) are used and have the same order of magnitude as when, for example, polyethylene emulsions are used. The soft handle brought about by amino silicones, however, is far superior to those which can be achieved with polyethylene, as is familiar to any textile expert.

EXAMPLE 5

In the examples so far, the softener according to the invention was applied via a padder in order to achieve a strictly defined softener content on the fabric.

In industrial practice, however, the softener is applied in a washing machine by the exhaust process.

5a) 35 pairs of jeans (about 30 kg) were desized in a long liquor, bleached and rinsed in a horizontal drum washing machine. After draining, 300 l of fresh water were added, and 1.8 kg of softener 8 (see page 23), corresponding to 0.3 kg of silicone, were added. After a running time of 30 minutes, the softener was exhausted to about 45%.

5b) To increase the yield, in addition to the 1.8 kg of softener No. 8, a known activator was added in a parallel experiment, specifically in an amount of 0.04 kg.

The rate of exhaustion rose to 90% by this addition.

The activator is a product which has been known for a long time for promoting the exhaustion capacity of softener emulsions. It comprises an aqueous-alcoholic solution of 40% of triethanolamine titanate and 11% of zinc acetate·2 $H_2O$.

What is claimed is:

1. A yellowing-resistant, softened, indigo-dyed fabric comprising an indigo-dyed fabric, treated with and containing a residue of an aqueous softening composition comprising an organopolysiloxane containing at least one Si-C bonded hydrocarbon group bearing a polar group, and a polyglycoside surfactant of the formula $$R—O—Z_o$$

wherein R is a linear or branched, saturated or unsaturated alkyl radical, and Z is an oligoglycoside radical having a degree of polymerization, o, greater than 1 to about 10.

2. The indigo-dyed fabric of claim 1, wherein R is an alkyl group containing from about 8 to about 24 carbon atoms.

3. The indigo-dyed fabric of claim 1, wherein the degree of polymerization of said oligoglycoside radical is between 1.1 and 3.

4. The indigo-dyed fabric of claim 1 wherein the weight ratio of organopolysiloxane to polyglycoside surfactant is from 10:1 to 0.5:1.

5. The indigo-dyed fabric of claim 1 wherein said polar group comprises one or more zroups selected from the group consisting of amino, ammonium, epoxy, hydroxyl, amido, mercapto, carboxyl, sulfuric acid, and salts and esters thereof.

6. The indigo-dyed fabric of claim 1, wherein said aqueous softening composition further comprises a co-surfactant comprising an amine, ester, ketone, or glycol ether.

7. A process for the preparation of indigo-dyed textile articles, comprising a) obtaining a sized indigo-dyed textile article;

b) enzymatically desizing said sized indigo-dyed textile article to form a desized indigo-dyed textile article;

c) optionally bleaching said desized indigo-dyed textile article;

d) optionally stone washing said desized indigo-dyed textile article;

e) softening said desized indigo-dyed textile article by treating with an aqueous softening composition comprising an organopolysiloxane containing at least one Si-C bonded hydrocarbon group bearing a polar group, and a polyglycoside surfactant of the formula $$R—O—Z_o$$

wherein R is a linear or branched, saturated or unsaturated alkyl radical, and Z is an oligoglycoside radical having a degree of polymerization, o, greater than 1 to about 10.

8. The process of claim 7, wherein R is an alkyl group containing from about 8 to about 24 carbon atoms.

9. The process of claim 7, wherein the degree of polymerization of said oligoglycoside radical is between 1.1 and 3.

10. The process of claim 7, wherein the weight ratio of organopolysiloxane to polyglucoside surfactant is from 10:1 to 0.5:1.

11. The process of claim 7, wherein said polar group comprises a group selected from the group consisting of amino, ammonium, epoxy, hydroxyl, amido, mercapto, carboxyl, sulfuric acid, and salts or esters thereof.

12. The process of claim 7, wherein said treating further comprises including in said aqueous softening composition, a cosurfactant comprising an amine, ester, ketone, or glycol ether.

13. In a process for the softening of an indigo-dyed fabric by treatment with an aqueous softening composition, the improvement comprising:

selecting as said aqueous softening composition, an aqueous softening composition comprising an organopolysiloxane containing one or more Si-C bonded hydrocarbon groups bearing at least one polar group, and a polyglycoside surfactant of the formula $$R—O—Z_o$$

wherein R is a linear or branched, saturated or unsaturated alkyl radical, and Z is an oligoglycoside radical having a degree of polymerization, o, greater than 1 to about 10.

14. The process of claim 13, wherein R is an alkyl group containing from about 8 to about 24 carbon atoms.

15. The process of claim 13, wherein the degree of polymerization of said oligoglycoside radical is between 1.1 and 3.

16. The process of claim 13, wherein the weight ratio of organopolysiloxane to polyglucoside surfactant is from 10:1 to 0.5:1.

17. The process of claim 13, wherein said polar group comprises a polar group selected from the group consisting of amino, ammonium, epoxy, hydroxyl, amido, mercapto, carboxyl, sulfuric acid, and salts and esters thereof.

18. The process of claim 13, wherein the treatment further comprises including in said aqueous softening composition, a cosurfactant comprising an amine, ester, ketone, or glycol ether.

19. The process of claim 13, wherein said aqueous softening composition is free of cationic fatty softeners.

* * * * *

UNITED STATES PATENT AND TRADEMARK OFFICE

CERTIFICATE OF CORRECTION

PATENT NO. : 6,042,615
DATED : March 28, 2000
INVENTOR(S) : Peter Habereder et al It is certified that error appears in the above-identified patent and that said Letters Patent is hereby corrected as shown below:

Column 13, line 13, claim 5, delete "zroups" and insert --groups--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*